United States Patent [19]

Jensen

[11] 4,186,533

[45] Feb. 5, 1980

[54] MODULAR BUILDING STRUCTURE

[76] Inventor: David C. Jensen, 81 W. Cordova St., Vancouver, B.C., Canada, V6B 1C8

[21] Appl. No.: 796,974

[22] Filed: May 16, 1977

[51] Int. Cl.[2] ..... E04F 11/00; E04B 1/00

[52] U.S. Cl. ..... 52/184; 46/31; 52/264; 52/282; 52/285; 52/584; 52/586

[58] Field of Search ..... 211/182, 183, 189; 40/125 H; 46/31, 29, 20, 21; 160/135, 351; 52/584, 284, 582, 285, 586, 287, 281, 731, 282, 264, 236.1, 608, 184, 126

[56] References Cited

U.S. PATENT DOCUMENTS

| | | | |
|---|---|---|---|
| 764,208 | 7/1904 | Alford | 211/183 X |
| 1,306,246 | 6/1919 | Bried | 52/608 X |
| 1,418,257 | 5/1922 | Hay | 52/285 |
| 2,647,287 | 8/1953 | Jones | 52/582 |
| 2,748,954 | 6/1956 | Murren | 211/182 X |
| 2,834,065 | 5/1958 | Mueller | 52/582 |
| 2,882,689 | 4/1959 | Huch et al. | 52/182 X |
| 2,970,677 | 2/1961 | Springs, Jr. et al. | 52/584 |
| 3,002,315 | 10/1961 | Kuhn | 52/281 X |
| 3,152,366 | 10/1964 | McCrory et al. | 52/282 X |
| 3,191,244 | 6/1965 | Burke | 52/584 X |
| 3,229,334 | 1/1966 | Thome | 403/173 |
| 3,286,423 | 11/1966 | Donlon | 52/282 X |
| 3,343,324 | 9/1967 | Gordon | 52/582 X |
| 3,400,958 | 9/1968 | Haimes et al. | 52/584 X |
| 3,428,108 | 2/1969 | Singer | 160/135 |
| 3,486,287 | 12/1969 | Guillon | 52/282 X |
| 3,503,165 | 3/1970 | Nakazawa et al. | 52/126 |
| 3,517,467 | 6/1970 | Propst et al. | 52/584 X |
| 3,660,952 | 5/1972 | Wilson | 52/81 |
| 3,661,410 | 5/1972 | Larson et al. | 52/582 X |
| 3,793,789 | 2/1974 | Greenamyer | 52/584 X |
| 3,830,030 | 8/1974 | Yoshida | 52/584 |
| 3,866,364 | 2/1975 | Pollard | 52/282 X |
| 3,927,481 | 12/1975 | Safranek | 160/135 X |
| 3,931,894 | 1/1976 | Murphy | 211/189 |
| 3,968,617 | 6/1976 | Hodge | 52/284 X |
| 3,992,828 | 11/1976 | Ohe | 52/69 |
| 4,008,553 | 2/1977 | Oliver | 52/584 |
| 4,011,682 | 3/1977 | Ach | 160/135 X |
| 4,027,444 | 6/1977 | Berg | 52/281 |
| 4,035,972 | 7/1977 | Timmons | 52/281 X |

FOREIGN PATENT DOCUMENTS

| | | | |
|---|---|---|---|
| 516203 | 9/1955 | Canada | 52/281 |
| 618461 | 9/1935 | Fed. Rep. of Germany | 52/282 |
| 1518818 | 2/1967 | France . | |

*Primary Examiner*—Leslie Braun
*Attorney, Agent, or Firm*—Robert W. Beach; Ward Brown

[57] ABSTRACT

In a modular wall and floor structure, the edges of wall panels have upwardly directed hooks projecting outwardly from their opposite vertical edges. Short lengths of multisided hollow extrusion have a downwardly opening longitudinal slot in each side which slots receive the panel hooks of adjacent panels for connecting such panels to form an exhibit array. Adjacent ends of overhead beams are connected to each other and to the upper ends of the panels by downwardly directed beam hooks received in upper longitudinal slots in the lengths of extrusion. The lower portions of the connected or unconnected panels can be clamped between modular floor components.

2 Claims, 15 Drawing Figures

12
11
13
9
6
8
7
10
12
11
13
6
28
6
5'
6
8
7
6
5
3
4
3
2
1
6
30
1
2

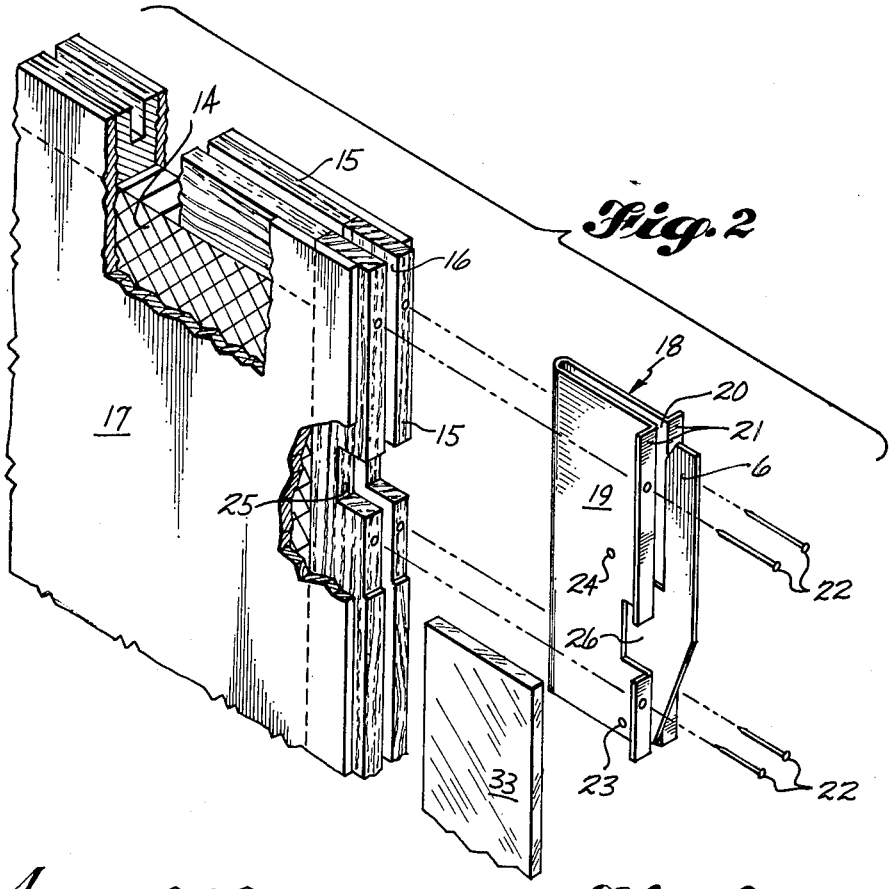
Fig. 2
Fig. 4
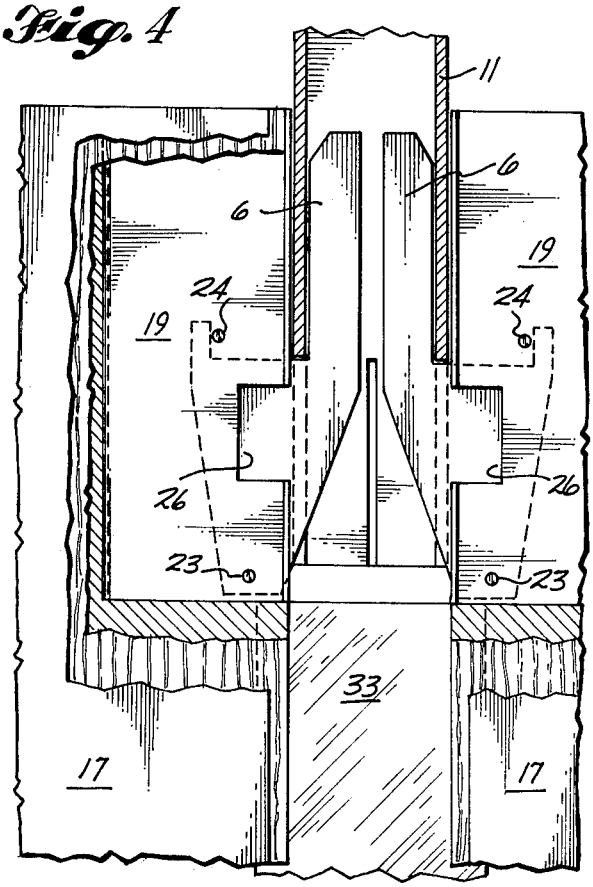
Fig. 3
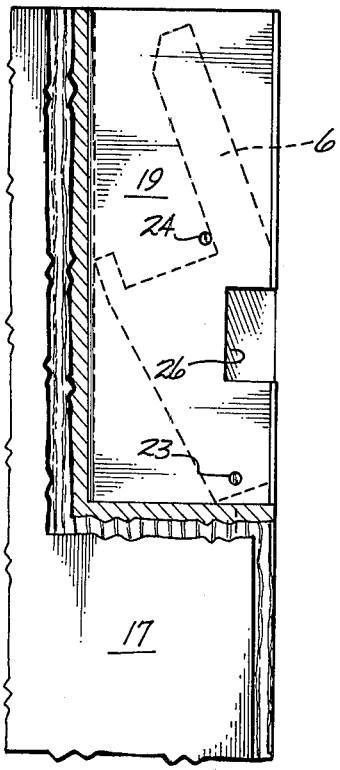

MODULAR BUILDING STRUCTURE

BACKGROUND OF THE INVENTION

1. Field of the Invention

The present invention relates to modular building structures.

2. Prior Art

The problem with known modular components and structures is that they require many complicated and often bulky parts. Consequently, such structures take much time to assemble or disassemble.

SUMMARY OF THE INVENTION

It is an object of the present invention to provide modular building structures using a minimum number of component parts.

Another object is to provide such structures which may be quickly and easily assembled or disassembled.

A further object is to provide such structures having component parts which may be assembled to provide structures of a variety of shapes.

It is also an object to provide such structures particularly adapted to form exhibit arrays for art galleries or museums.

The foregoing objects can be accomplished by providing wall panels which can be supported by their lower ends being secured to modular floor components or which can be interconnected by upwardly directed hooks projecting outwardly from the panel edges. Multisided hollow connection members having a downwardly-opening lower longitudinal slot in each side connect adjacent panels by the panel hooks being received in the connection member lower slots. Panels can be connected at angles to be mutually supporting. To steady connected panels, overhead beams are connected to each other and to the upper ends of the panels by downwardly directed beam hooks received in upwardly-opening upper longitudinal slots in the connection members. Further support is provided by clamping the lower portions of the panels between modular floor components.

BRIEF DESCRIPTION OF THE DRAWINGS

FIG. 2 is a fragmentary exploded top perspective of an upper corner of a wall panel in accordance with the present invention with some parts broken away.

FIG. 3 is a fragmentary elevation of a wall panel with its hook in retracted position with some parts broken away.

FIG. 4 is a fragmentary elevation of two wall panels connected by a connection member, some parts being broken away and some parts being shown in section.

DETAILED DESCRIPTION

Figure 1:
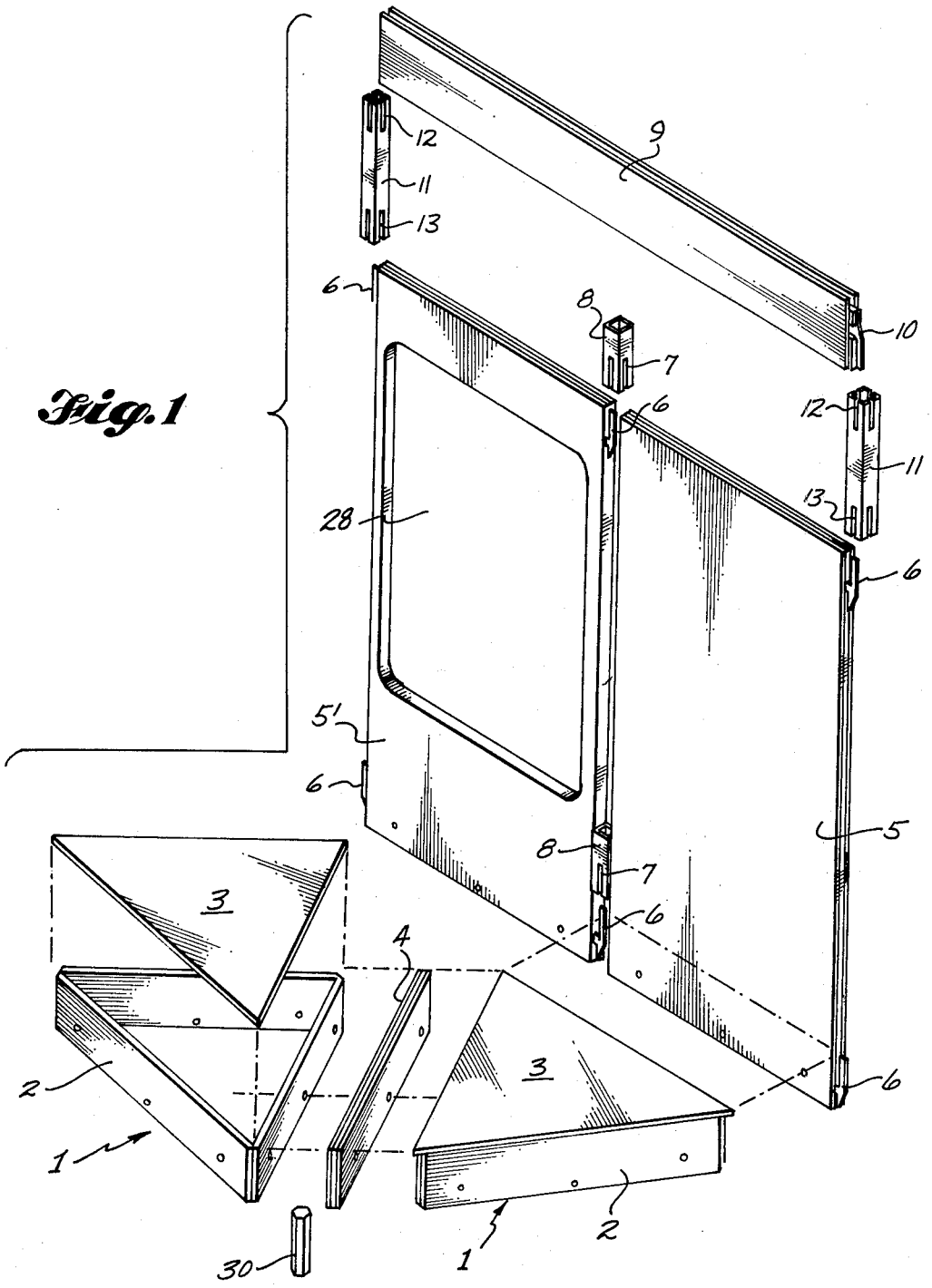
FIG. 1 is an exploded top perspective of some representative component parts of a modular building structure in accordance with the present invention.

As shown in FIG. 1, representative component parts of a modular building structure in accordance with the present invention include floor components 1 of equilateral triangle cross section. The sides of each floor component are formed by base strips 2 covered by a top 3 whose edges are coplanar with the outside of the strips. The floor components are maintained with a side of one component parallel to, spaced from and in alignment with a side of another floor component by a spacer 4 secured to both components such as by bolts extending through apertures in the base strips and spacer. One of the floor components may have a side secured to the lower portion of a wall panel 5 which has upwardly directed hooks 6 projecting outwardly from the opposite vertical edges of such panel. Panel 5 is positioned with an edge adjacent to the edge of another panel 5' which also has upwardly directed hooks 6. The two panels are connected by their adjacent hooks being received in the lower longitudinal slots 7 in opposite sides of multisided hollow connection members 8 formed of short lengths of tubular extrusion. An overhead beam 9 having a fixed downwardly directed beam hook 10 projecting from each of its ends is connected to the panels by beam connection members 11 which have upper longitudinal slots 12 receiving the beam hooks and lower longitudinal slots 13 receiving panel hooks.

As best seen in FIGS. 2, 3 and 4, each wall panel is of conventional construction and includes a core 14 enclosed by perimetric channel members 15, the flanges of which define an outwardly opening groove 16, and a thin outer wall covering or facing 17. Hooks may be fixedly secured to the panel edges at corresponding locations on different panels. However, in the panel shown in FIGS. 3, 4 and 5 each hook 6 is carried by a bracket 18 which includes a return bent channel portion 19 forming an outwardly-opening slot 20 and attachment flanges 21. Such flanges are secured to a vertical edge of the panel by screws 22 so that the bracket channel portion is received in the panel perimetric groove. The panel edge is recessed to receive the bracket flanges.

A panel hook 6 is swingably carried by bracket 18 by a pivot 23. Such hook is movable from a position where it projects outwardly from the panel edge to a position retracted substantially within the bracket slot 20 and the panel groove 16. Outward swinging of the hook is limited by a stop 24. As best seen in FIG. 3, access to a retracted hook is provided by a transverse notch 25 in the panel edge and an aligned notch 26 in the bracket.

Figure 5:
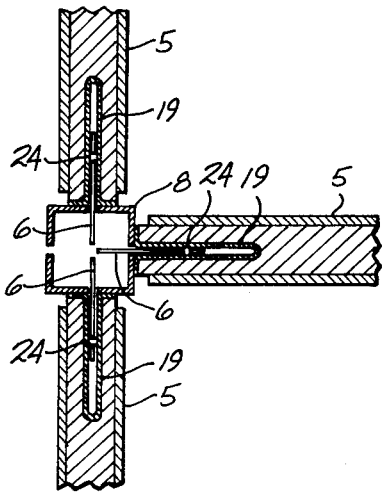
FIG. 5 is a fragmentary plan of three wall panels connected by a square connection member.

As shown in FIGS. 4 and 5, two coplanar panels can be connected edge-to-edge by their adjacent projected hooks 6 being received in the lower longitudinal slots in the opposite sides of a panel connection member 8, shown in FIGS. 1 and 5, or a beam connection 11, shown in FIGS. 1 and 4. The tips of hooks 6 are beveled to guide a connection member as it is fitted over the hooks. The margins of a filler strip 33 of sheet material may be fitted into the grooves of the panels to bridge between the adjacent panel edges.

Figure 6:
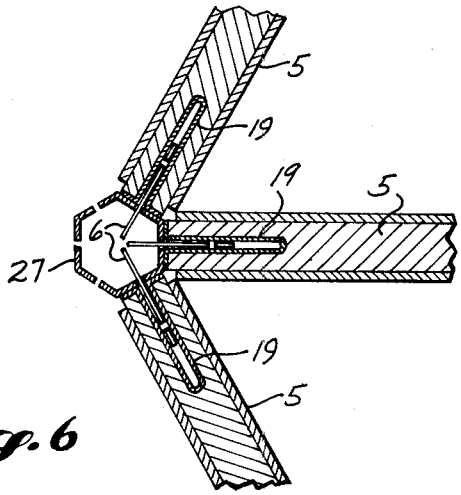
FIG. 6 is a fragmentary plan of three panels connected by a hexagonal connection member.

As best seen in FIG. 5, if connection members having a square cross section are used, two or more panels can be interconnected so that each panel is perpendicular to at least one other panel. As shown in FIG. 6, connection members 27 of hexagon cross section may be used to connect panels to each other at angles of 60 degrees or multiples of 60 degrees. The distance between the opposite sides of the square connection member 8 is the same as the distance between the opposite sides of the hexagonal connection member 27. However, the width of each side of the square connection member is slightly greater than the thickness of a panel, whereas the width of each side of the hexagon connection member is slightly less than the thickness of a panel.

Figure 7:
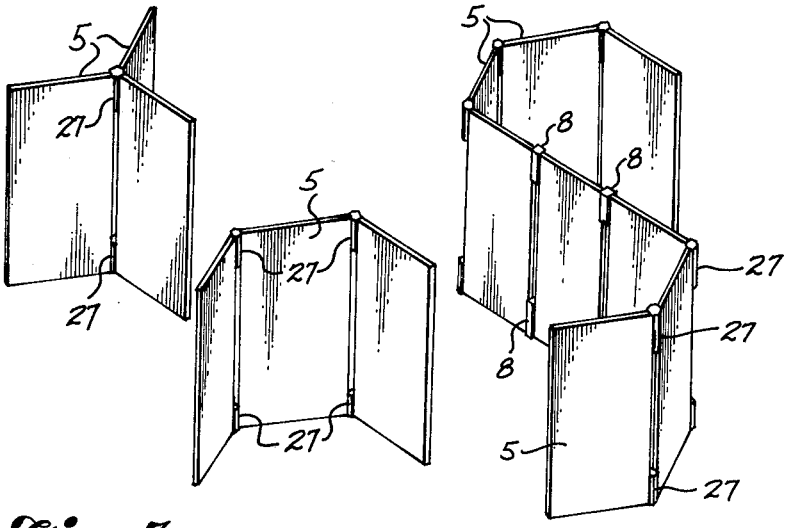
FIG. 7 is a top perspective of several wall panels connected at angles to each other for mutual support.
Figure 8:
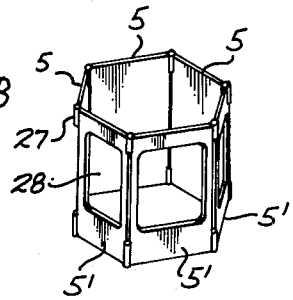
FIGS. 8, 9 and 10 are top perspectives of wall panels connected edge-to-edge to provide support and stability of the panels such as in forming display cases.
Figure 9:
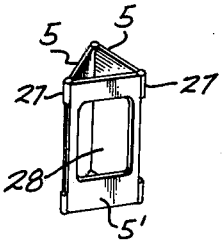
Figure 10:
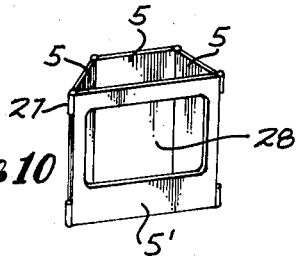

As shown in FIG. 7, several panels may be connected at angles to each other so that such panels are mutually supporting. FIGS. 8 and 9 show one or more panels 5' having viewing apertures 28 connected edge-to-edge to unapertured panels 5 to form a substantially enclosed display case. In the display case of FIG. 10, a double width apertured panel is connected to standard unapertured panels.

Figure 11:
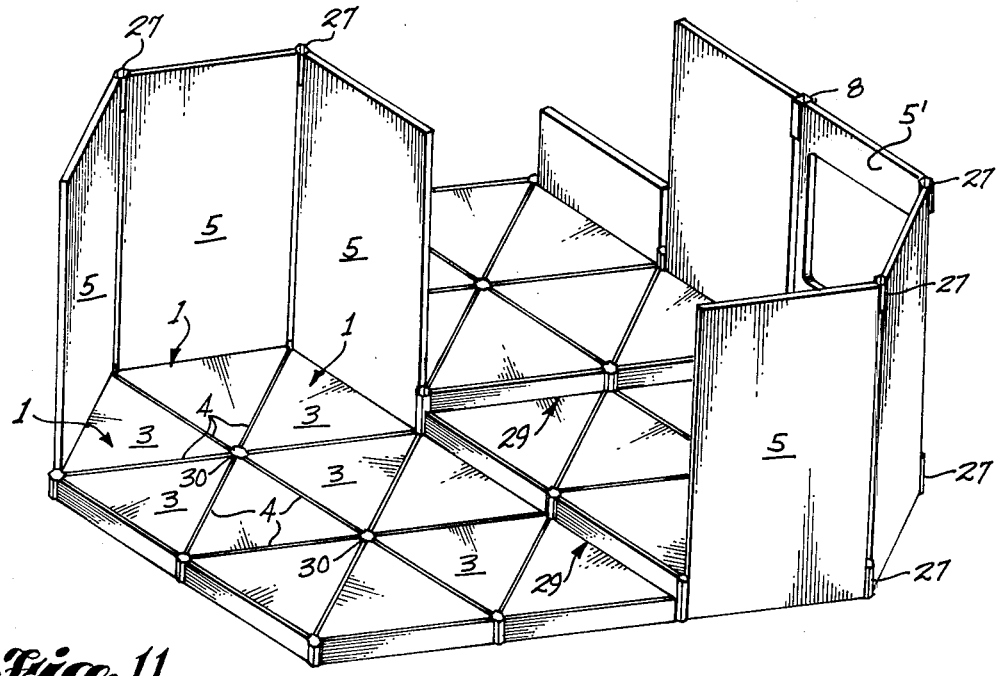
FIG. 11 is a top perspective of an exhibit array of wall panels supported by modular floor components.

In the exhibit array of FIG. 11, connected panels are supported by floor components 1 secured to the lower portions of such panels. The floor components may all be of the same height, or floor components of different heights may be used to provide steps 29 for staging or seating depending upon the degree of difference of elevation between the various levels. Spacers 4, also shown in FIG. 1, between adjacent floor components are of a height at least as great as an assembled floor component to keep the component tops 3 from sliding. Hexagonal plugs 30 fill the gaps between the vertices of the connected floor components. Some of the panels act as spacers and are clamped between floor components.

Figure 12:
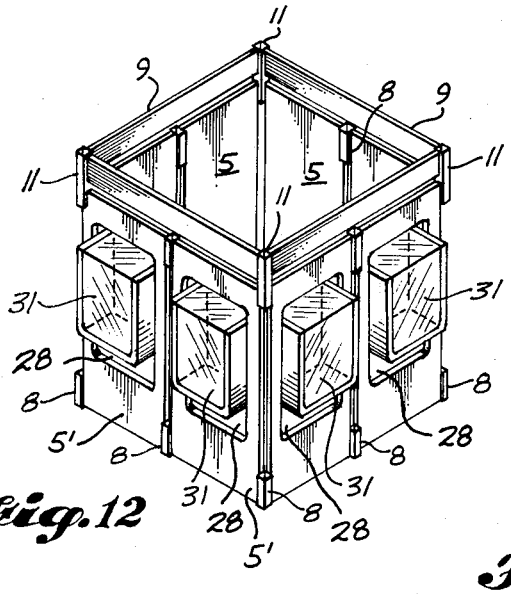
FIG. 12 is a top perspective of wall panels connected edge-to-edge to form a display case with overhead beams connected to each other and to the wall panels by beam connection members.

Another method of supporting connected panels is shown in FIG. 12. In that figure eight panels are connected to form a square display case with the length of each side of the square equal to the combined widths of two panels and a panel connection member, and overhead beams 9 have an equal length. The fixed downwardly directed hooks of the overhead beams are received in the upper slots of beam connection members 11. The lower slots of the beam connection members receive adjacent panel hooks at the upper corners of the display case. Each of the beams has an upper groove, best seen in FIG. 1, for receiving electrical wiring or downwardly projecting lugs of display accessories such as lights or specialized power outlets. In several of the panels a glass enclosed display box 31 is mounted in a panel viewing aperture 28 as alternates to windows or openings.

Figure 13:
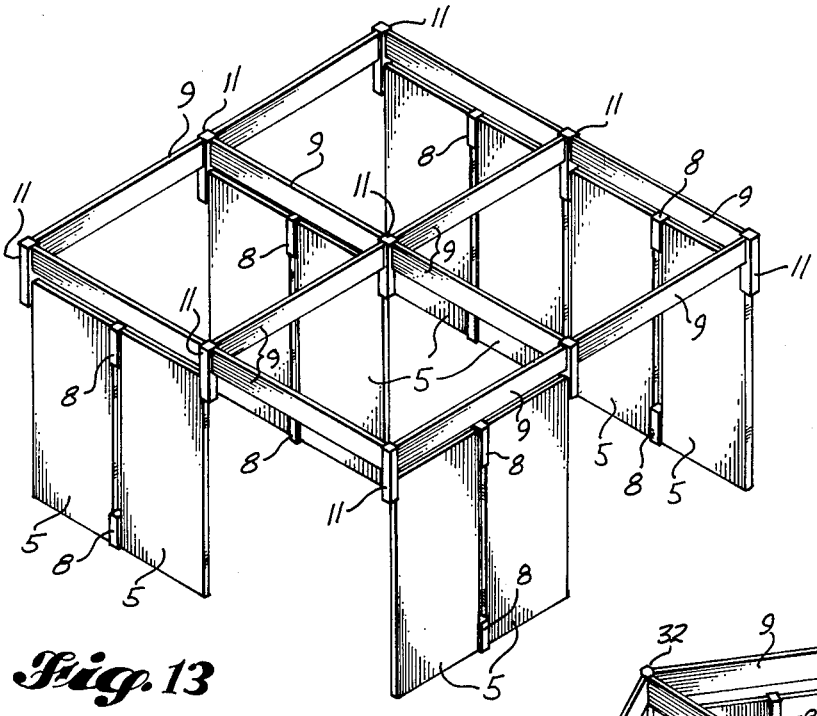
FIGS. 13 and 14, on the drawing sheet with FIGS. 5 and 6, are top perspectives of exhibit arrays with coplanar connected wall panels steadied by overhead beams.
Figure 14:
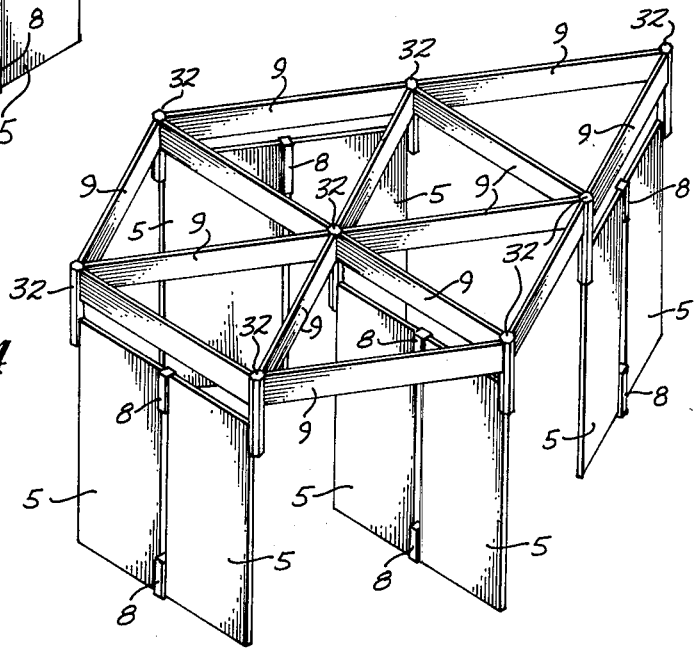
Figure 15:
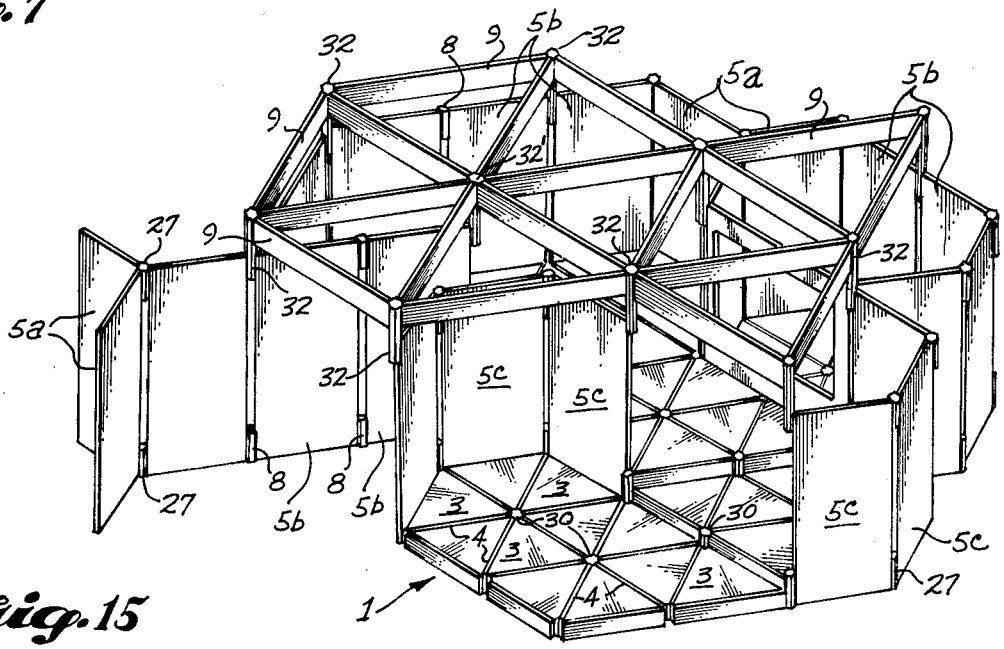
FIG. 15, on the drawing sheet with FIG. 7, is a top perspective of an exhibit array with some wall panels connected at angles to each other for mutual support, some wall panels supported by floor components and some wall panels steadied by overhead beams.

In FIGS. 13 and 14 an exhibit array of panels 5 is steadied by interconnected overhead beams 9. In FIG. 13 square beam connection members 11 are used, whereas in FIG. 14 hexagonal beam connection members 32 are used. The exhibit array shown in FIG. 15 illustrates all three methods of supporting and steadying connected panels. Some of the panels 5*a* are arranged in freestanding groups, such panels being connected at angles to adjacent panels for mutual support; many of the panels 5*b* are steadied by interconnected overhead beams; and some of the panels 5*c* can have their lower portions secured to modular floor components. Each beam end is connected to the top of a panel by a hexagonal beam connection member 32. However if a beam connection member interconnects several beams, such as the member numbered 32' in FIG. 15, such member could be replaced by a panel connection member and the panel under such member could be removed without greatly affecting the stability of the array.

In each of the above embodiments the majority of the panels have the same width; the connection members, whether square or hexagonal, have the same width; the floor components are of equilateral triangle cross section with a side of the triangle of a length equal to the width of a panel; and each overhead beam is of a length equal to the combined widths of two panels and one connection member. Consequently, the building structure components can be quickly and easily interconnected to form exhibit arrays of a variety of shapes. All components are flat for stacking during storage or shipping. The adjacent ends of the floor component strips 2 can be connected by hinges or pins to secure them in triangular relationship to support the flooring sections 3.

I claim:

1. A modular floor system comprising a plurality of floor components each of which includes a base of equilateral triangle shape and a sheet material top of substantially the same shape supported by said base with the edges of said top substantially coplanar with the sides of said base, spacers secured to said floor components for maintaining each of said components with at least one of its sides spaced from, parallel to and in alignment with a side of another of said components, each of said spacers being of a height at least as great as the combined heights of an adjacent floor component base and the top supported thereby for preventing shifting of such top relative to such base, said spacers and said floor components forming a plurality of gaps of hexagon cross section at the apexes of floor components, and a plurality of plugs of hexagon cross section substantially filling said gaps.

2. The system defined in claim 1, in which some of the floor components have the same height, and some of the components have a different height so that the floor system includes steps.

* * * * *

UNITED STATES PATENT AND TRADEMARK OFFICE

CERTIFICATE OF CORRECTION

PATENT NO. : 4,186,533

DATED : February 5, 1980

INVENTOR(S) : David C. Jensen

It is certified that error appears in the above-identified patent and that said Letters Patent are hereby corrected as shown below:

Title page, [56], line 3, cancel "764,208" and insert --764,028--.

Signed and Sealed this

*Twenty-ninth* Day of *April 1980*

[SEAL]

*Attest:*

SIDNEY A. DIAMOND

*Attesting Officer*

*Commissioner of Patents and Trademarks*